US005792335A

United States Patent [19]

Barton

[11] Patent Number: 5,792,335

[45] Date of Patent: Aug. 11, 1998

[54] ANODIZATION OF MAGNESIUM AND MAGNESIUM BASED ALLOYS

[75] Inventor: Thomas Francis Barton, Epsom, New Zealand

[73] Assignee: Magnesium Technology Limited, Auckland, New Zealand

[21] Appl. No.: 595,354

[22] Filed: Feb. 1, 1996

[30] Foreign Application Priority Data

Mar. 13, 1995 [NZ] New Zealand ..... 270696

[51] Int. Cl.[6] ..... C25D 9/00; C25D 9/02

[52] U.S. Cl. ..... 205/321; 205/318; 205/333

[58] Field of Search ..... 205/318, 321, 205/316, 333

[56] References Cited

U.S. PATENT DOCUMENTS

| | | | |
|---|---|---|---|
| 2,305,669 | 12/1942 | Budiloff et al. | 205/318 |
| 2,901,409 | 8/1959 | De Long | 205/318 |
| 2,926,125 | 2/1960 | Currah et al. | 205/321 |
| 3,345,276 | 10/1967 | Munroe | 204/32 |
| 4,551,211 | 11/1985 | Kobayashi et al. | 204/37.6 |
| 4,978,432 | 12/1990 | Schmeling et al. | 204/58.4 |
| 5,385,662 | 1/1995 | Kurze et al. | 205/316 |

FOREIGN PATENT DOCUMENTS

| | | |
|---|---|---|
| 2549092 | 5/1983 | France . |
| 4104847 | 4/1993 | Germany . |
| 294237 | 9/1929 | United Kingdom . |
| 493935 | 10/1938 | United Kingdom . |

OTHER PUBLICATIONS

Derwent Abstracts Accession No. 85-313716/50 no date available.

*Primary Examiner*—Kathryn L. Gorgos
*Assistant Examiner*—Edna Wong
*Attorney, Agent, or Firm*—Merchant, Gould, Smith, Edell, Welter & Schmidt, P.A.

[57] ABSTRACT

This invention provides a method for the anodization of magnesium in magnesium based alloys using an electrolytic solution containing ammonia. The use of such an electrolytic solution alters the manner in which the anodization occurs to provide a coating on the magnesium material without spark formation.

9 Claims, 1 Drawing Sheet

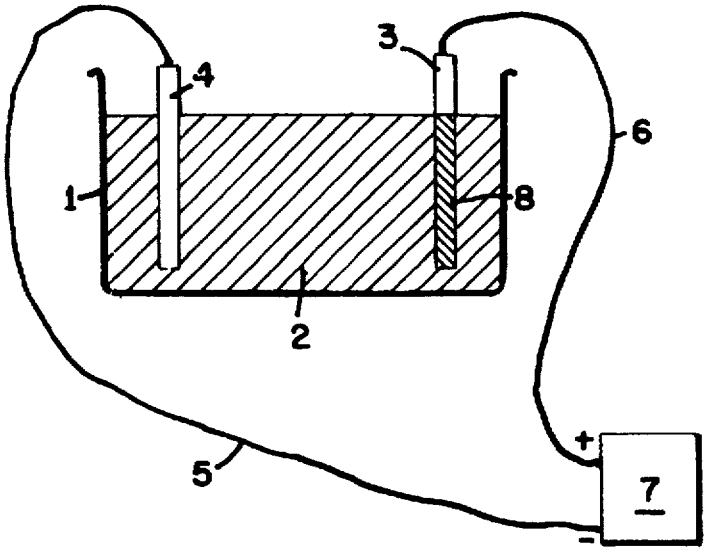
3
4
6
1
8
2
5
+
7
-

ANODIZATION OF MAGNESIUM AND MAGNESIUM BASED ALLOYS

BACKGROUND (1) Field of the Invention

The invention relates to a method for the anodization of magnesium and magnesium based alloys and products produced by that method.

(2) Description of the Prior Art

A major component of the building industry and, in particular, although not solely, the metal joinery industry has been aluminium based products. Although the price of aluminium has increased in recent years, it is still the principal material of many components due to its strength, weight and the finishes available to aluminium.

By contrast, magnesium prices have remained relatively stable and is not a serious competitor to aluminium. It exhibits similar properties in terms of strength and weight.

In the case of both aluminium and magnesium, these materials require some form of corrosion resistant and wear resistant coatings. Both materials easily discoloured upon exposure to the atmosphere through oxidization.

The anodization of aluminium is a relatively easy procedure compared with the equivalent anodization of magnesium. It is for this reason that the aluminium has been preferred despite the rising price. Therefore, it would appear that an advantage exists for magnesium should the anodization process be simplified to allow this material to compete equally with aluminium in a number of applications.

Previous attempts to anodized magnesium have involved the use of base solutions of concentrated alkaline hydroxides. These usually take the form of sodium or potassium hydroxides in a concentrated solution. This anodization process is generally provided through the supply of a DC current at a range of, for example, 50 volts to 150 volts. Some methods have suggested the use of AC current as well.

A coating is then formed on the magnesium through the formation of sparks within the bath containing the sodium or potassium hydroxide and it is the tracking of the sparks across the surface of the magnesium element which slowly places the coating onto the magnesium. The use of sparks throughout the process leads to a relatively high current usage and leads to significant heat absorption by the bath itself. Therefore, any commercial anodization plant also requires substantial cooling equipment to reduce the temperature of the bath through the use of this process.

The final coating formed by this anodization process was an opaque coating with a white or grey color possible. However, it is not a direct visual comparison with anodized aluminium and, therefore, has a problem in matching other components made from anodized aluminium leading most manufacturers only to use aluminium throughout their manufacture.

OBJECT OF THE INVENTION

Therefore, it is an object of the present invention to provide a method for the anodization of magnesium or magnesium alloys which will provide a coating similar to anodized aluminium, add corrosion resistance and/or overcome some of the disadvantages of the prior art and/or at least provide the public with a useful choice.

SUMMARY OF THE INVENTION

Accordingly, in a first aspect, the invention may broadly be said to consist in a method for the anodization of magnesium based materials comprising:

providing an electrolytic solution containing ammonia;

providing a cathode in said solution;

placing magnesium based material as an anode in said solution; and passing a current between the anode and cathode through said solution so that a coating is formed on said material.

Accordingly, in a second aspect, the invention may broadly be said to consist in a material containing magnesium anodized by the method as previously defined.

Further aspects of this invention may become apparent to those skilled in the art to which the invention relates upon reading the following description.

BRIEF DESCRIPTION OF THE DRAWINGS

Description of the preferred embodiments of the invention will now be provided with reference to the drawings in which:

FIG. 1 shows a diagrammatic view of an anodization bath in accordance with an embodiment of this invention.

DETAILED DESCRIPTION OF PREFERRED EMBODIMENTS

This invention provides a method for the anodization of magnesium containing material such as magnesium itself or its alloys. The process has been found to be useful on substantially pure magnesium samples as well as magnesium alloys such as AZ91 and AM60 which are common magnesium alloys used in casting.

The process of this invention utilises a bath 1 having a solution 2 into which the magnesium containing material 3 may be at least partially immersed.

Electrodes 3 and 4 are provided in the bath 1 and into the solution 2, the solution 2 being an electrolytic solution.

Suitable connections such as cables 5 and 6 are provided from the electrodes 3 and 4 to a power supply 7.

The solution 2 is provided to include ammonia to a suitable concentration. The concentration of the ammonia in the electrolytic solution 2 may vary, however, a preferred range of between 1% and 33% w/v is desirable. It has been found that solutions in which the concentration of ammonia is below 1% w/v tends to cause some sparks to form with the method of formation of the coating tending more towards a coating formed through spark formation similar to prior art methods of anodization. A 33% maximum concentration of ammonia acts as an upper limit.

In the preferred forms of the invention, the ammonia concentration has been found to work suitable in the region of 5 to 10% w/v or, more preferably, 5 to 7% w/v.

A current from the power supply 7 is passed through suitable connections such as cables 5 and 6 to the electrodes 3 and 4 immersed within the electrolytic solution 2. In this example, the process of formation of the coating generally occurs when the voltage reaches the approximate range of 220 to 250 V DC. It should be noted that the prior art anodization processes occur between 50 and 150 V DC and, therefore, a reduction of the concentration of ammonia below the desired level tends to allow sparks to form through the process taking up the properties of the prior art alkaline hydroxide anodization processes before the voltage can reach a level suitable to form the coating in accordance with the present invention. Other embodiments can allow within the approximate range of 170 to 350 v DC.

In a process such as this embodiment, the formation of sparks can occur for a number of reasons. The ammonia acts to repress sparks generally, but the concentration of salts in the bath also has an effect. If the ammonia gets too low, sparks may form. If the concentration of phosphate is increased greatly, sparks may occur at higher voltages, through the coating may form completely before the voltages increased to such a voltage. For example, in a solution of 5% ammonia and 0.05M sodium ammonium hydrogen phosphate, the coating is formed between 220 and 250 V DC without any significant spark formation. The coating that results is a protective coating and semi-transparent. If the voltage is increased to 300 V DC, the coating is thicker and becomes opaque, and still no sparks occur in the formation process.

By contrast, a solution of 5% ammonia and 0.2M sodium ammonium hydrogen phosphate, the coating forms between 170 and 200 V DC. Attempts to increase the voltage significantly above 200 V DC may produce sparks.

In a further example, a solution with 3% ammonia and 0.05M sodium ammonium hydrogen phosphate was tried. Sparks occurred at, approximately 140 V DC and this is prior to a good coating having been formed on the magnesium anode.

In a further embodiment, peroxide may be added to the electrolytic solution. The addition peroxide has been observed to decrease the voltage of which the coating forms without spark formation. For example, a solution of 5% ammonia, 0.05M sodium ammonium hydrogen phosphate and 0.1M sodium peroxide produces a coating at 210 V DC very similar to a 300 V DC coating formed in the absence of the peroxide. This may be advantageous in circumstances where a lower operating voltage is desired.

It has been further observed that decreasing the level peroxide to 0.05M produces no significant difference to the coating then the example with no peroxide. Further, increasing the peroxide to 0.2M appears to prevent any reasonable coating being formed due to the presence of damaging sparks.

On this basis, a further preferred embodiment in which peroxide is added at, approximately, 0.1M may allow lower operating voltages if desired.

Upon application of the current to the electrolytic solution 2, a coating forms on the material 3 forming the anode on that portion 8 of the material 3 which is immersed within the solution 2. The process itself if, to a large degree, self terminating with the current drawn by the anodizing bath 1 falling off as the depth of coating on the portion 8 increases. In this manner, the placement of an article 3 as an anode within the anodizing bath 1 tends to draw current until the coating is formed and when sufficient coating exists to substantially isolate the magnesium in the material 3 from the electrolytic solution 2, the current drawn falls and can act as an indicator that the coating has been applied.

A number of additives may be provided in the solution 2 to alter the final coating and its appearance. For example, phosphate compounds may be used to provide a finish similar to anodized aluminium and it has been found that phosphate compounds provided in the range of 0.01 to 0.2 molar can be suitable. Generally a concentration less than 0.01 tends to provide finish which is somewhat too transparent to suitable be compared with anodized aluminium. Similarly, concentrations greater than 0.2 lead to an opaque finish which again alters from the appearance of anodized aluminium. A preferred range of 0.05 to 0.08 molar of a phosphate compound such as ammonium sodium hydrogen phosphate is suitable. The ammonium phosphate has been found particularly useful and other ammonium phosphate compounds could act as direct substitutes.

Anodisation using the ammonium phosphate compounds gives significant corrosion resistance to the coating. Also the coating is particularly suited to further coating with paint or other organic sealers.

An alternative additive to provide a finish similar to anodised aluminium has been found to be the use of fluoride and aluminate in similar concentrations to the phosphate compounds. Typical concentrations of compounds such as sodium aluminate and sodium fluoride are 0.05 molar of each of these compounds. As the concentrations of sodium aluminate and sodium fluoride is increased towards 0.1 molar, the finish changes to a pearl colored finish. Although this may be aesthetically pleasing in itself, it is not directly comparable with the anodized aluminium finish and, therefore, may be less suitable if it is desired to manufacture components of the same joinery from the different materials and be able to provide matching finishes on both aluminium and magnesium products.

The process itself is conducted at relatively low currents compared with the previous anodization of magnesium processes. The current drawn is in the order of 0.01 amps per square centimeter of magnesium surface. The low current and lack of spark formation lead to a decrease in the temperature rise within the bath 1 to form an equivalent depth of coating compared with the alkaline hydroxide baths used previously. This reduction in the temperature rise of the bath leads to a significant decrease in the cooling equipment necessary to conduct the process.

Current preferred forms of the invention have been conducted at room temperature and it is preferred, although not essential, to conduct the anodization process at less than 40° C.

If alternative finishes are required and the production of a finish similar to the anodized aluminium is not necessarily required, a variety of coloring agents could be added to the solution. The anodization process would still provide corrosion resistance and act as an alternative to powder coating of such components.

It should be noted that the choice of additives includes a phosphate additive and/or a fluoride additive. If the fluoride additive is used in substitution for the phosphate additive, this leads to greater problems with the disposal of the solution. Fluoride compounds themselves are not particularly environmentally sensitive. By comparison, the phosphate compounds are less damaging to the environment and may be preferred for this reason alone.

The additives may also include sealants or other compounds and many of the additives used in the previous anodisation processes such as aluminates, silicates, borates, fluoride, phosphate, citrate and phenol may be used.

The coating formed on the magnesium is a mixed coating of magnesium oxide and magnesium hydroxide with further constituents according to any particular additives used in the process. For example, the embodiment in which sodium ammonium hydrogen phosphate is provided leads to a magnesium phosphate component in the coating. Further, the embodiment in which fluoride and aluminate compounds are provided may lead to the presence of magnesium fluoride and magnesium aluminate in the finished coating.

It should further be noted that the use of ammonia in the solution may necessitate the use of ventilation in the area about the anodization bath 1.

The process as defined also tends to provide the coating somewhat faster than the prior use of alkaline hydroxide solutions.

Thus it can be seen that the process and the products from the process may provide significant advantages over the prior art methods and products.

Where in the foregoing description, reference has been made to specific components or integers of the invention having known equivalents, then such equivalents are herein incorporated as if individually set forth.

Although this invention has been described by way of example and with reference to possible embodiments thereof, it is to be understood that modifications or improvements may be made thereto without departing from the scope or spirit of the invention.

I claim:

1. A method for the anodization of magnesium based materials comprising:

providing an electrolytic solution containing at least 1% w/v of ammonia and a phosphate compound in the range of 0.01–0.2 molar, said phosphate compound being selected from the group consisting of sodium hydrogen phosphate, ammonium sodium hydrogen phosphate, ammonium dihydrogen phosphate, and diammonium hydrogen phosphate;

providing a cathode in said solution;

placing magnesium based material as an anode in said solution; and passing a current between the anode and cathode through said solution so that a coating is formed on said material.

2. A method for the anodization of magnesium as claimed in claim 1 wherein said magnesium based materials comprise magnesium in the range of 70% to 100%.

3. A method for the anodization of magnesium as claimed in claim 1 wherein said ammonia is provided in said solution in the range of 1% to 33% w/v.

4. A method for the anodization of magnesium as claimed in claim 3 wherein said ammonia is provided in said solution in the range of 5% to 10% w/v.

5. A method for the anodization of magnesium as claimed in claim 1 wherein said current is provided by a DC supply having a potential in the range of 170 to 350 V DC.

6. A method for the anodization of magnesium as claimed in claim 1 wherein said phosphate compound comprises sodium hydrogen phosphate.

7. A method for the anodization of magnesium as claimed in claim 1 wherein said solution contains ammonium sodium hydrogen phosphate.

8. A method for the anodization of magnesium as claimed in claim 1 wherein said solution contains ammonium dihydrogen phosphate.

9. A method for the anodization of magnesium as claimed in claim 1 wherein said solution includes diammonium hydrogen phosphate.

* * * * *